United States Patent [19]

Lin et al.

[11] 4,109,375

[45] Aug. 29, 1978

[54] METHOD OF MAKING ADHESIVE COATED ELECTRICAL CONDUCTORS

[75] Inventors: Kou Chi Lin, Hickory; Edmund E. Woods, Sharon, both of Pa.

[73] Assignee: Westinghouse Electric Corp., Pittsburgh, Pa.

[21] Appl. No.: 743,828

[22] Filed: Nov. 22, 1976

[51] Int. Cl.[2] ..... H01F 7/06

[52] U.S. Cl. ..... 29/605; 174/119 R; 336/205; 427/118; 427/120

[58] Field of Search ..... 29/605; 336/205; 174/119 R, 119 C, 120 R, 120 C, 120 SR; 427/118, 120, 195, 202, 203, 116

[56] References Cited

U.S. PATENT DOCUMENTS

| | | | |
|---|---|---|---|
| 2,739,371 | 3/1956 | Grisdale et al. | 29/605 |
| 3,504,104 | 3/1970 | Suzuki | 336/205 |
| 4,055,688 | 10/1977 | Caratsch | 427/195 |

*Primary Examiner*—Carl E. Hall
*Attorney, Agent, or Firm*—D. R. Lackey

[57] ABSTRACT

An electrical conductor having a plurality of sides which define a generally rectangular cross-sectional configuration is coated with an electrical insulating material on all sides. An adhesive coating having a predetermined thickness and width dimension is applied to only a selected side of the conductor. The thickness of the adhesive is reduced, and the width of the adhesive coating is increased, when the conductor is wound into a coil having a plurality of turns, and the coil is heated to fuse the adhesive coating and provide an adhesive bond between the turns of the coil.

8 Claims, 8 Drawing Figures

METHOD OF MAKING ADHESIVE COATED ELECTRICAL CONDUCTORS

BACKGROUND OF THE INVENTION

1. Field of the Invention

The invention relates to adhesive coated electrical conductors, bonded coils, and methods for producing adhesive coated conductors and bonded coils.

2. Description of the Prior Art

The concentric high and low voltage windings of a core-form power transformer are subjected to tremendous forces during a short circuit condition. The outer or high voltage winding is subjected to a radial force in the outward direction and the inner or low voltage winding is subjected to a radial force in the inward direction. Taps and manufacturing variations result in the electrical centers of the windings, i.e., the midpoint of the ampere turn distribution across a coil or winding, to be offset in a direction parallel to the winding axis or longitudinal centerline. The fundamental force of radial repulsion effectively acts between the electrical centers, and when the electrical centers are offset, a force component exists which tends to move the high and low voltage windings in opposite axial directions. Short circuit currents may typically be 15 or more times normal full load current, and the short circuit force on a winding is proportional to the square of the current in the winding.

The short circuit forces are also increased due to the displacement of the first half cycle of current, which displacement is a function of the ratio of the resistance to the reactance of the transformer. This increase due to current displacement is 3 to 4 times the value of the force with symmetrical current. Therefore, the short circuit forces may be 800 to 1,000 times the forces existing during full load current. The axial component is typically in the range of 7 to 15%, and thus the force which attempts to move the windings axially apart is indeed substantial.

Power transformers must, therefore, be constructed to withstand the short circuit forces to which they may be subjected. High density pressboard, improved mechanical stabilization of cellulosic insulation, mechanical prestressing of coils, and other techniques, have been developed over the years to increase the mechanical strength of transformer windings. The coils or windings are tight when manufactured. The substantial amount of cellulose material distributed through the height of a coil makes it difficult to maintain the tight initial construction, but the techniques referred to have contributed greatly to achieving stable dimensions over the operating life of a power transformer.

Environmental and energy considerations have been an impetus to the development of electrostatic dry powder techniques for coating magnet wire, replacing the conventional solvent based materials. With solvent based materials, the wire is coated in a series of passes to achieve the desired build dimension, requiring a substantial amount of energy to drive off the solvent and then the airborne solvent becomes a pollution problem which is costly to deal with. The electrostatic dry powder technique uses no solvent, and the desired build is achieved in a single pass. The only energy required is that which is necessary to heat the wire to the fusing and curing temperature of the particulated deposit on the wire.

The use of the electrostatic dry powder technique is economically attractive for insulating the copper and aluminum strap or wire used in power transformers. The turn insulation presently used is a thin, thermally upgraded cellulosic or synthetic paper. The use of a thin coating of resinous insulation on the strap conductor of a power transformer would reduce the cost of the windings. It would also reduce the amount of cellulose or other compressible material across the coil length, resulting in a turn insulation structure which will not age during the normal thermal cycling of transformer apparatus, and insulation which will not contribute to loosening of the winding or coil through use since its compressibility is insignificant. Thus, the mechanical strength of the winding should not be deleteriously affected with age. Copending application Ser. No. 725,215, filed Sept. 22, 1976, entitled "Apparatus for Cleaning and Coating an Elongated Metallic Member," now U.S. Pat. No. 4,051,809, which is assigned to the same assignee as the present application, discloses apparatus for successfully coating copper and aluminum strap or wire, providing the very thin, uniform, void-free coatings which are essential to use of such insulation in a power transformer winding.

The development of successful electrostatic dry powder techniques for insulating copper and aluminum strap or wire, however, did not prove to be the only problem encountered in substituting a resinous coating for paper in insulating the turns of power transformers. Short circuit tests have shown that the very smooth glassy finish of the powder coated conductor detracts from the short circuit strength of the winding. The paper turn insulation provides a much higher coefficient of friction between adjacent conductor turns, and it adds substantially to the short circuit strength of the winding.

Adhesive overcoats have been applied to magnet wire and foil, such as disclosed in U.S. Pat. Nos. 3,412,354 and 3,504,104, respectively, for providing conductors which may be wound into coils, the turns of which are then bonded together to increase the mechanical strength of the coil. However, applying prior art adhesive overcoat techniques to resin coated copper or aluminum conductor adversely affects the cost and/or the space factor of a coil wound from such conductor. Thus it would be desirable to be able to use resin coated conductor, such as disclosed in the hereinbefore mentioned copending patent application, in a transformer winding, and to achieve the required mechanical strength without suffering offsetting disadvantages of higher cost and/or lower space factor.

SUMMARY OF THE INVENTION

Briefly, the present invention relates to a new and improved insulated, bondable conductor, windings constructed of such conductor, and methods of making such conductor and windings. The new and improved conductor is formed of a good conductor of electricity, such as copper or aluminum, having a plurality of sides which define a substantially rectangular cross-sectional configuration. All sides of the conductor are coated with a resinous insulating material, and a single selected side is coated with a resinous adhesive. The coating of adhesive has a predetermined thickness and width dimension, with the width dimension being less than the width of the associated conductor side.

The new and improved winding is constructed of the insulated, bondable conductor, with the coating of adhesive being disposed between adjacent turns of the winding. Final processing of the winding, which includes heating the winding to remove all traces of moisture, causes the adhesive to soften and flow under the contact pressure between adjacent conductor turns. The initial thickness of the adhesive is substantially reduced as the adhesive is squeezed and forced substantially over the entire surfaces of the adjacent sides of the conductor turns. Thus, the adhesive detracts insignificantly from the space factor of the winding.

New and improved methods of making the insulated and bondable conductor and winding add significantly to the success of insulated bondable conductor. The preferred technique for applying the resinous insulating coating on all sides of the conductor is the electrostatic, dry powder process, as the application of the powder to the wire while the wire is below the melting temperature of the resinous powder permits the desired build of 1 to 2 mils to be achieved, even on the edges of rectangular conductor. To apply the adhesive in powder form using the electrostatic technique and achieve the required very thin coating, such as 1 mil, would require quenching the conductor following the heat cure of the insulating coating, another electrostatic coater in series with the electrostatic coater which applies the insulating coating, and another heating source for heating the wire. The new and improved method permits the adhesive to be applied in powder form to the insulated wire immediately after the wire leaves the heating source which cures the insulating coating. The required thin build dimension cannot be achieved by applying powder to the hot conductor, but the method of applying a relatively thin bead of adhesive to one side of the wire, which bead has a small width dimension compared to the width of the selected side, enables the powder to be applied to the hot conductor. This arrangement eliminates the need for another electrostatic coater, and another heating source. Thus, the electrostatic technique and the fluidized bed-hot part technique are combined in a manner which provides the desired end product while eliminating the need for costly processing apparatus.

BRIEF DESCRIPTION OF THE DRAWING

The invention may be better understood, and further advantages and uses thereof more readily apparent, when considered in view of the following detailed description of exemplary embodiments, taken with the accompanying drawings in which.

DESCRIPTION OF THE PEFERRED EMBODIMENTS

Figure 1:
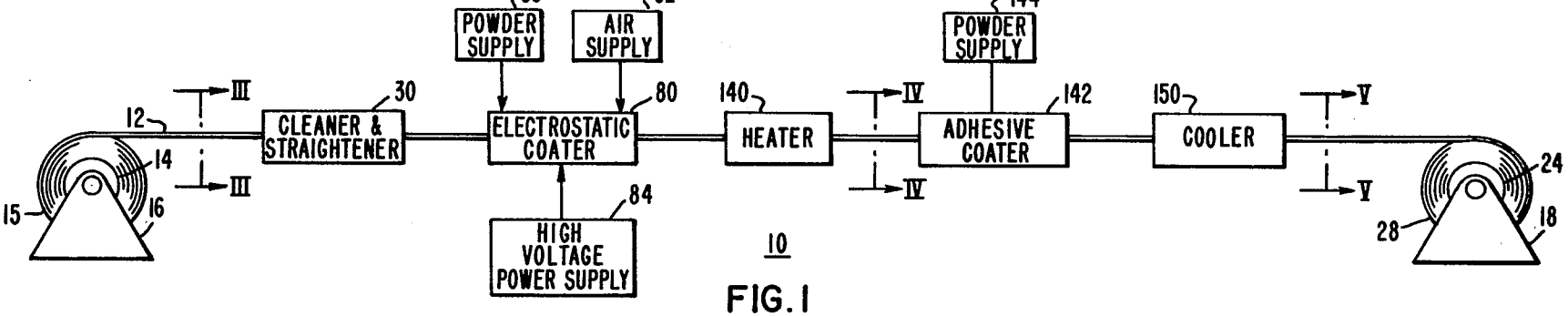
FIG. 1 is a diagrammatic view, in elevation, of apparatus for making an insulated, bondable electrical conductor according to the teachings of the invention.

Referring now to the drawings, and FIG. 1 in particular, there is shown electrostatic powder coating apparatus 10 constructed according to the teachings of the invention. Only those details of apparatus 10 necessary to understand the teachings of the invention are illustrated, as the hereinbefore mentioned copending application may be referred to for further details of electrostatic coating apparatus which may be used in apparatus 10. Apparatus 10 is illustrated and described relative to a single elongated metallic member 12, but any practical number may be simultaneously coated. Further, the elongated metallic member 12 will be assumed to have a generally rectangular cross-sectional configuration, i.e., a parallelogram having right angles, in which the base and height are equal, i.e., a square, or unequal. A rectangular configuration is assumed because the invention is particularly suitable to wire of such configuration.

The wire to be coated is wound on a reel or spool 14 to form a supply roll 15 which is mounted on pay-off means 16, with the wire being electrically grounded, such as through the pay-off means.

The wire 12 is pulled from the supply roll 15 by take-up means 18. The wire is cleaned and straightened, in cleaning and straightening apparatus 30. The cleaning and straightening apparatus 30 may include means for mechanically abrading the wire surface to remove burrs, and chemical cleaning apparatus which may include ultrasonic chemical cleaning apparatus.

The cleaned and straightened wire 12 is now ready for electrostatic deposition of insulating particles thereon, which step is performed by electrostatic coating apparatus 80. The powder may be fluidized via an air supply 82 which is electrically charged via a power supply 84 in a manner similar to that shown in U.S. Pat. No. 3,916,826. The coating apparatus 80 also includes a supply 86 of heat fusible, particulated electrical insulating material, such as the epoxy powder formulation disclosed in copending application Ser. No. 661,074, filed Feb. 25, 1976, now U.S. Pat. No. 4,040,993, which is assigned to the same assignee as the present application.

The wire 12 with the electrostatically applied particles thereon is then heated in heating means 140 to fuse the particles and provide a uniform, tenacious film of insulation on the wire. Heating means 140 may include first means for preheating the wire to a temperature above the softening point of the particles, and second means for heating the wire to the desired heat fusing and curing temperature. The preheat is selected to heat the wire without air movement, as the insulating particles must not be disturbed. An induction pre-heat, or an oven pre-heat, such as an oven with infrared heaters, is suitable. The pre-heat means preferably heats the wire to a temperature of about 125° C. A pre-heat, before the wire enters the more elevated temperature of the final heating step has been found to reduce the chance of air being trapped in the coating.

The means for providing the final heating step, fuses and cures the particles to form a thin insulating film. The final heating means may be an infrared oven which heats the wire to a temperature dependent upon the length of time that the wire is in the oven, and also on the formulation of the particular powder being used. In order to reduce the length of the oven and still permit the desired line operating speed, the oven preferably heats the wire to the upper end of the temperature range for the particular powder utilized. For the epoxy formulation disclosed in the hereinbefore mentioned copending application, a temperature of about 500° C. is suitable.

Instead of quenching the coated wire 12 as it leaves the heater 140, as described in the hereinbefore mentioned copending application, a preferred embodiment of the invention utilizes the heat in the wire due to the heating step in the step of applying an adhesive on the coated wire. This step includes adhesive coating apparatus 142 and a supply 144 of resin in powder form. The powdered resin is preferably a thermosetting resin capable of being partially cured to a dry non-tacky but heat fusible state, i.e., B-staged. A subsequent application of heat softens the resin, enabling it to function as an adhesive, which heat then completes the cure, converting the adhesive to an infusible thermoset state so that an adhesive bond provided by the resin will retain its strength at the elevated temperature to which the conductor will be subjected during use. While many different powder compositions may be used, an epoxy powder commercially available from Westinghouse Electric Corporation under their identification No. BT-6517 has been satisfactorily used.

The adhesive coating apparatus 142 is spaced from the heater 140 such that the wire 12 will be at the proper temperature for the particular powder formulation being used, such as about 200° C. for the BT-6517, to melt the powder without curing the resulting film beyond the dry, non-tacky, heat fusible B-stage. Air jets or similar cooling apparatus may be used to accelerate the reduction in wire temperature, if necessary.

The insulated and adhesively coated wire 12 is then quenched in a cooler 150, such as by a water quench, and the wire is then wound on a spool 24 to provide a roll 28 of insulated, bondable electrical conductor.

Applying a finely divided resinous powder to a wire which is at a temperature above the melting temperature of the powder will provide a relatively thick coating, such as 0.030 inch, while the desired coating is closer to 0.001 inch. An adhesive coating thicker than about 1 or 2 mils would adversely affect the space factor of a transformer winding or coil wound of the conductor. To apply the powder adhesive to the wire 12 and achieve a build of 1 mil would require that the insulated wire to be cooled below the melting temperature of the powder, and the powder would then have to be applied electrostatically, requiring a duplication of the electrostatic coater 80, high voltage power supply 84, air supply 82, and the heating means 140. The present invention enables a 1 to 2 mils coating to be achieved in the final product, i.e., a coil or winding, while applying the adhesive to the conductor 12 in a much thicker layer.

Figure 2:
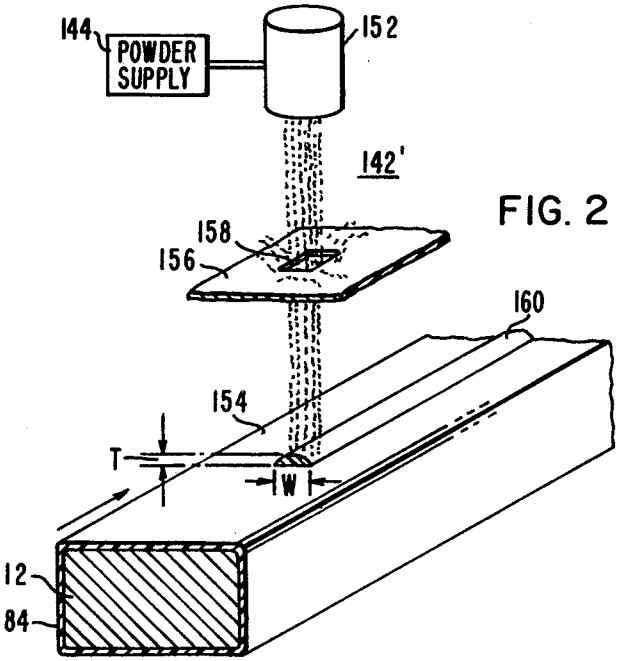
FIG. 2 is a perspective view of apparatus which may be used for the adhesive coating apparatus shown in block form in FIG. 1.

FIG. 2 is a perspective view of adhesive coating apparatus 142' which may be used for the adhesive coating apparatus 142 shown in FIG. 1. The heated conductor 12, which has a thin cured coating 84 of resinous insulation on its four sides, is directed through a chamber which includes a gun 152 connected to receive adhesive in the powder form from the power supply 144. The gun 152 directs the powder towards a single selected side 154 of the heated conductor 12, with a mask 156 having an opening 158 therein being disposed between the conductor 12 and the gun 152. The spacings of the wire, mask and gun, the size of the opening 158 and the rate at which the powder is expelled from the powder gun 152 are all selected to provide a bead 160 of adhesive which has the desired width W and thickness T. The powder is directed at the selected side through the mask and it melts as it contacts the heated conductor to provide a solid, non-tacky bead which is only partially cured. The width W is substantially less than the width of the associated side on which the bead 160 is disposed, and the thickness T is substantially thicker than the desired thickness of an adhesive coating in a transformer coil or winding.

For example, an aluminum conductor having a cross-sectional dimension of 0.410 inch by 0.129 inch having a cured coating of electrical insulation which is about 2 mils thick, on all sides, was heated to a temperature of about 200° C. The epoxy formulation BT-6517 was directed at the 0.410 inch wide side of the conductor through a mask having an opening sized 0.125 inch by 1 inch and the wire was then quenched in water. The spacing between the gun nozzle and the mask was 12 inches, and the spacing from the mask to the wire was 0.5 inches. This arrangement provided a dry, non-tacky B-staged bead of adhesive having a width of about 0.0625 inch and a thickness of 0.0313 inch.

Strips of the resulting insulated and bondable wire were then clamped together, using C-clamps, hand tight, with an adhesive bead being disposed against an insulated wire surface having no adhesive. Five different samples were subjected to the normal heating process to which a transformer winding would be subjected, i.e., heated to a temperature of 120° C. for about 4 hours. The samples were then removed from the clamping fixture and subjected to a shear test. The average shear load for the five samples tested was 3,081 psi, ranging between a low of 2,331 psi and a high of 4,040 psi. In all cases, the break occurred between the coating of electrical insulation and the aluminum conductor, not across the adhesive bond. The thickness of the adhesive was reduced from the original 0.0313 inch thickness to a thickness of about 0.003 inch.

Figure 3:
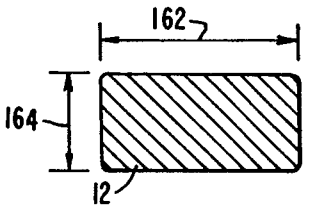
FIGS. 3, 4 and 5 are cross-sectional views of the conductor shown in FIG. 1, taken between arrows III—III, IV—IV, and V—V, respectively.
Figure 4:
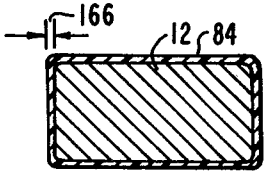
Figure 5:
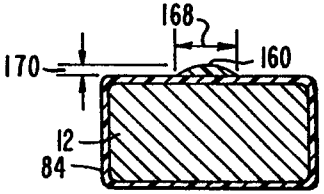

FIGS. 3, 4 and 5 are cross-sectional views of the conductor or wire 12, taken between arrows III—III, IV—IV, and V—V, respectively, of FIG. 1. FIG. 3 illustrates the wire 12 prior to the coating of insulation being applied thereto. At this point in the process, the wire 12 is bare, having width and height dimensions indicated by arrows 162 and 164, respectively. FIG. 4 illustrates conductor 12 following the heating step performed by the heating means 140, at which point of the process the wire 12 has a substantially uniform coating 84 of electrical insulation thereon, which has a thickness indicated at 166. FIG. 5 illustrates the conductor 12 following the quenching step performed by cooler 150. A bead 160 of adhesive is disposed directly on the insulating coating, on the selected side of the conductor 12. The width and thickenss dimensions of bead 160 are indicated at 168 and 170, respectively.

Figure 6:
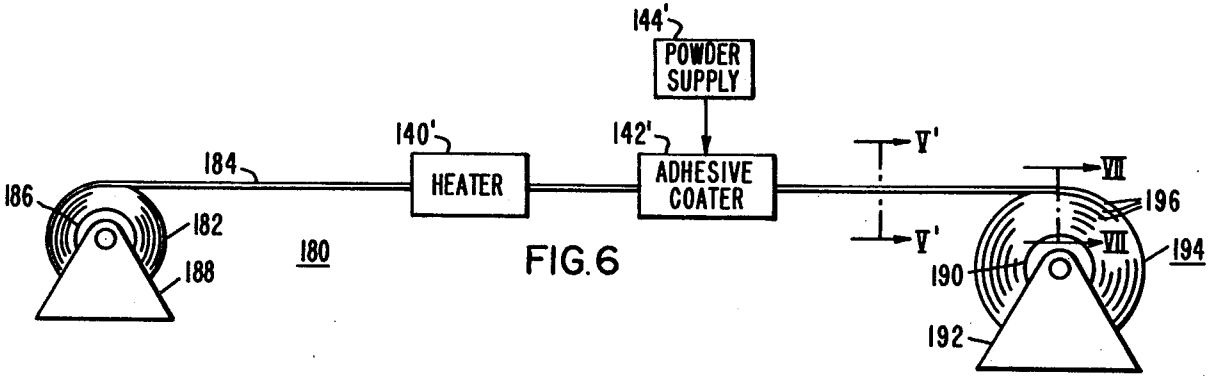
FIG. 6 is a diagrammatic view, in elevation, of apparatus for making an electrical coil or winding according to the teachings of the invention.
Figure 8:
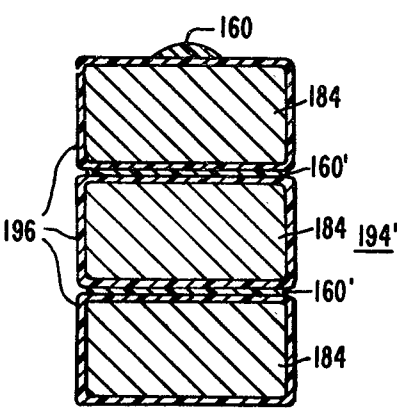
FIG. 8 is a cross-sectional view of the winding shown in FIG. 6 after the winding has been heated to a predetermined temperature.
Figure 7:
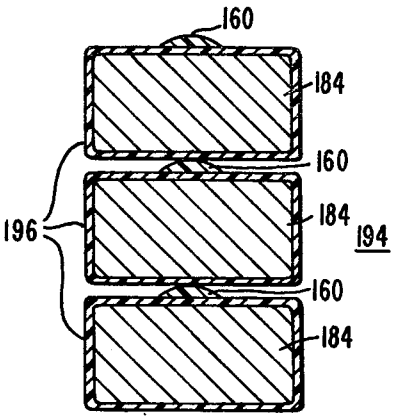
FIG. 7 is a cross-sectional view of the winding shown in FIG. 6, taken between arrows VII—VII.

FIG. 6 is a diagrammatic view, in elevation, of apparatus 180 for making an electrical conductor or winding according to the teachings of the invention. A roll 182 of electrical conductor 184, which includes a spool 186, is mounted on suitable pay-off apparatus 188 and it is wound about a coil mandrel 190 mounted on a suitable winding machine 194. The mandrel 190 is rotated to provide a coil or winding 194 having the required number of conductor turns 196. If the wire 184 is insulated and bondable, such as the wire 12 in roll 28 shown in FIG. 1, a cross-sectional view through coil 194, taken between arrows VII—VII, would appear as illustrated in FIG. 7. In other words, the beads 160 of adhesive would still be in the form illustrated in FIG. 5. Further processing of coil 194, which includes heating the coil to a temperature of 120° C. for 4 hours melts the bead 160 and those beads which are disposed between two conductor turns of the tightly wound coil are flattened and squeezed from the relatively thick dimension shown in FIG. 7 to a relatively thin dimension, such as 1 mil. FIG. 8 is a cross-sectional view of the coil 194 after heating thereof. Coil 194 is referred to in FIG. 8 as coil 194' in order to indicate that it has been further processed. The beads 160 which are squeezed and flattened are given the reference 160' in FIG. 8 in order to indicate their dimensional change.

If the roll 182 of conductor 184 is insulated but not bondable, FIG. 6 also illustrates that the bead 160 of adhesive may be applied as the coil 194 is being wound, utilizing equipment such as illustrated in FIG. 1 and hereinbefore described. For example, the wire 184 may be heated by a heater 140', similar to the heater 140 described relative to FIG. 1, and it may be coated by an adhesive coater 142' and powder supply 144', similar to the coater 142 and powder supply 144 described relative to FIGS. 1 and 2. A cross-sectional view of the wire 184 taken between arrows V'—V' in FIG. 6 would appear as shown in FIG. 5. The wire 184 may be quenched and dried prior to being wound on mandrel 190, or it may be wound while it is at an elevated temperature, causing immediate flattening of the bead 160. It is not important in this latter arrangement whether or not the cure of the insulation is stopped at the B-stage. It may be allowed to immediately cure to the infusible thermoset stage, but if it does not reach the thermoset stage, it will cure to this stage during further processing of the coil which includes a heating step.

We claim as our invention:

1. A method of making an insulated, bondable electrical conductor having a plurality of sides which define a generally rectangular cross-sectional configuration about a longitudinal axis, comprising the steps of:

providing finely divided heat fusible particles of electrical insulation, electrostatically applying the particles of electrical insulation to all sides of the electrical conductor, heating said electrical conductor and particles of electrical insulation above a predetermined first temperature to fuse the particles and provide a coating of electrical insulation on the electrical conductor, providing finely divided particles of an adhesive which are heat fusible at the predetermined first temperature, and directing the particles of adhesive against only a selected side of the electrical conductor while it is still above the predetermined first temperature to fuse the particles and provide a bead of adhesive thereon which extends in the same direction as the longitudinal axis of the electrical conductor, with the width dimension of the bead of adhesive being substantially less than the width dimension of the selected side.

2. The method of claim 1 wherein the step of directing the finely divided heat fusible particles of adhesive against the selected side of the electrical conductor includes the steps of providing a mask having an opening therein, and directing the finely divided particles of adhesive toward the selected side of the electrical conductor through the opening in the mask to provide the desired bead of adhesive.

3. A method of making an electrical coil, comprising the steps of:

providing an elongated electrical conductor having a plurality of sides which define a generally rectangular cross-sectional configuration, applying a resinous coating of electrical insulating material to all sides of the electrical conductor, heating said resinous coating above a predetermined first temperature to solidify it, providing finely divided particles of an adhesive which are heat fusible at the first temperature, directing the particles of adhesive against only a selected side of the electrical conductor while the solidified resinous coating is above the first temperature to fuse the particles and provide a coating of adhesive on the selected side having a predetermined thickness dimension and a width dimension which is less than the width of the selected side, winding said electrical conductor into a coil having a plurality of adjacent conductor turns, with the adhesive coating being between said conductor turns, softening said coating of adhesive while providing pressure between the conductor turns to reduce the predetermined thickness dimension of the coating of adhesive and provide a spacing between adjacent conductor turns which is less than the predetermined thickness dimension of the coating of adhesive, and solidifying the coating of adhesive to bond the adjacent conductor turns together.

4. The method of claim 3 wherein the step of softening the coating of adhesive is performed just prior to the winding step such that the step of winding the electrical conductor into a coil provides the pressure between the conductor turns, to increase the width dimension and decrease the predetermined thickness dimension of the coating of adhesive.

5. The method of claim 3 wherein the step of directing the finely divided heat fusible particles of adhesive against the selected side of the conductor includes the steps of providing a mask having an opening therein, and directing the finely divided particles towards the selected side through the opening in the mask to provide a coating having the desired width dimension.

6. The method of claim 3 wherein the step of applying the resinous coating to the electrical conductor includes the step of providing finely divided heat fusible particles of electrical insulation, and electrostatically applying the finely divided heat fusible particles to the electrical conductor prior to the step of heating the conductor to the predetermined first temperature.

7. The method of claim 3 wherein the step of heating the resinous coating cures the coating to an infusible thermoset state, and the step of solidifying the coating of adhesive cures the adhesive to an infusible, thermoset state.

8. The method of claim 3 wherein the step of softening the coating of adhesive is performed after the step of winding the electrical conductor into a coil, and wherein the winding step provides a contact pressure between adjacent conductor turns which reduces the predetermined thickness dimension of the coating of adhesive.

* * * * *